United States Patent [19]

Read et al.

[11] Patent Number: 4,518,939

[45] Date of Patent: May 21, 1985

[54] SOLENOID WITH RETAINER STOP

[75] Inventors: Reginald A. Read, LaGrange; Richard N. Houston, Western Springs, both of Ill.

[73] Assignee: Regdon Corporation, Brookfield, Ill.

[21] Appl. No.: 599,498

[22] Filed: Apr. 12, 1984

[51] Int. Cl.[3] ..... H01F 7/08

[52] U.S. Cl. ..... 335/262; 335/263; 335/279

[58] Field of Search ..... 335/255, 258, 261, 262, 335/263, 279

[56] References Cited

U.S. PATENT DOCUMENTS

| | | | |
|---|---|---|---|
| 2,239,312 | 4/1941 | Berges | 335/263 |
| 2,415,739 | 2/1947 | Fuchs | 335/263 |
| 3,259,811 | 7/1966 | Dunn | 335/263 X |
| 4,262,271 | 4/1981 | Bowers | 335/263 |

*Primary Examiner*—George Harris

*Attorney, Agent, or Firm*—Neuman, Williams, Anderson & Olson

[57] ABSTRACT

A solenoid is provided having a simplified construction which gives precise, uniform and reliable performance. The solenoid includes a base member which supports a bobbin. The bobbin is a one-piece, integrally molded unit with a hexagonal bore that extends through its entire length and a resilient retainer or catch that extends over and partially closes the bore at one end of the bobbin but flexes to admit a plunger. The catch and a plug in the bore at the opposite end of the bobbin confine the plunger between predetermined limits. The plunger has a hexagonal cross section sized to fit closely into the bore, allowing sliding movement of the plunger in the bore and preventing rotation of the plunger. The bobbin supports a coil that produces the magnetic flux to move the plunger longitudinally in the bore of the bobbin.

18 Claims, 5 Drawing Figures

FIG. 1
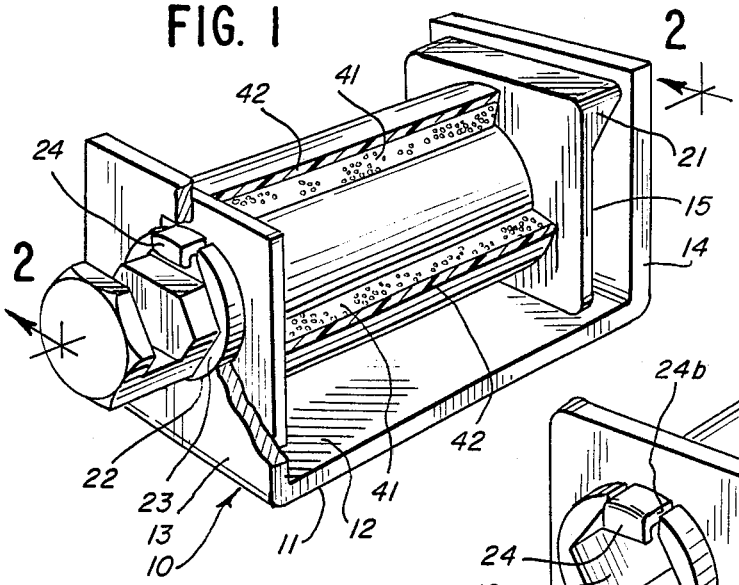
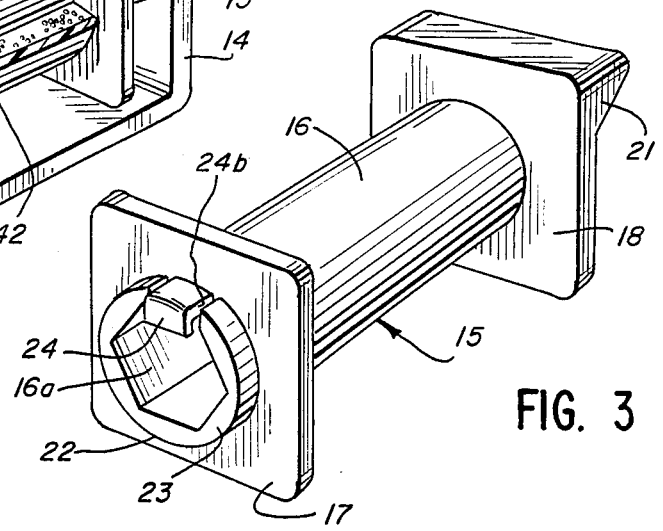
FIG. 3
FIG. 2
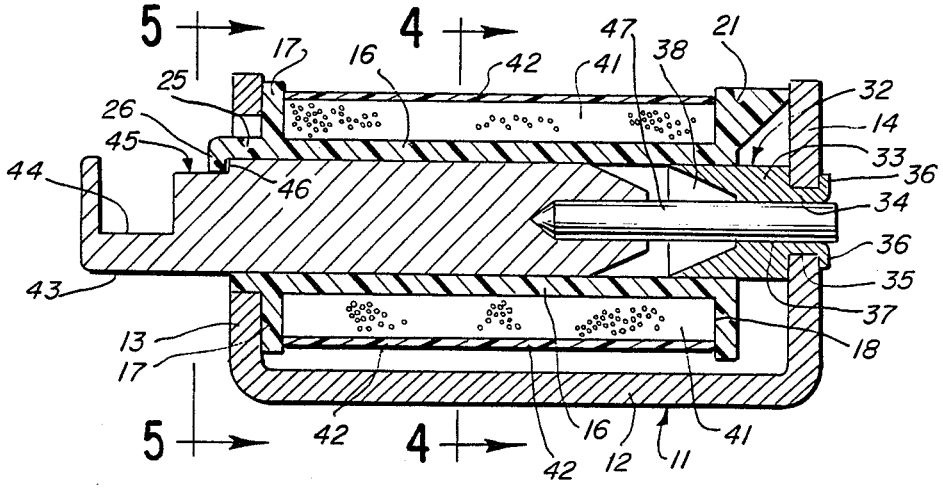
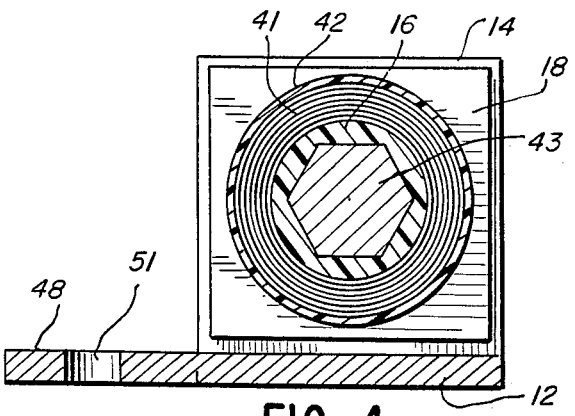
FIG. 4
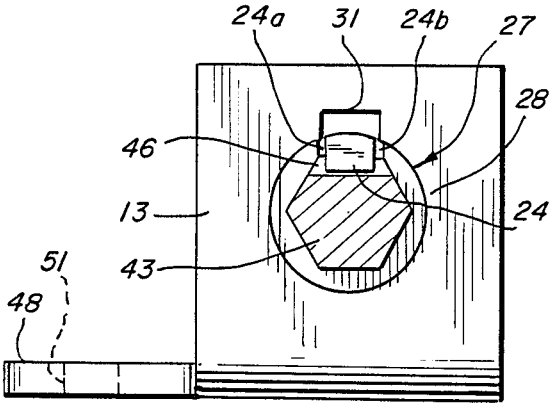
FIG. 5

SOLENOID WITH RETAINER STOP

BACKGROUND OF THE INVENTION

1. Field of the Invention

The present invention relates to an electromagnetic actuator and more particularly to a simplified solenoid device having an armature that moves between two well defined positions without rotating.

2. Description of the Prior Art

Electromagnetic actuators convert electrical impulses into mechanical action and perform many functions, especially in modern remote sensing and control applications. Many of these control applications require that the mechanical action produced by the actuators conform to strict requirements and tolerances. In solenoids for producing precise mechanical action, the armature must move longitudinally in the well of the solenoid between precisely defined limits without rotating.

The prior art solenoids that produce mechanical action conforming to strict requirements and precise tolerances are intricate devices having a multiplicity of close tolerance components. Many of these solenoids have internally or externally mounted springs that help move the actuator's armature along its stroke. These springs also assist in restraining the armature at the limits of the stroke. Other solenoids have armatures with plates which interact with the solenoid housing to stop the armature at precise, predetermined positions. Still other solenoids use complicated housing designs, permanent magnets and other close tolerance components made of various materials to provide precise, uniform and reliable performance. Producing these prior art solenoids requires accurate and expensive machines and machining techniques, complicated and time-consuming assembly processes, and the use of costly materials. In addition, the complexities of the prior art devices make them susceptible to malfunctions and breakdowns.

The solenoid of the present invention provides a mechanism with an armature that moves to precise, predetermined positions to perform various functions. It provides a construction which minimizes the expense of manufacture and assembly and gives precise, uniform and reliable performance. The solenoid of the present invention comprises a small number of components with sufficiently accurate and consistent tolerances to produce the requisite mechanical action and place the armature in proper position and alignment.

OBJECTS OF THE INVENTION

It is an object of this invention to provide an improved solenoid.

It is a further object of the present invention to provide an improved solenoid that overcomes the disadvantages and complexities of the prior art.

It is another object of this invention to provide a solenoid with a construction which minimizes the expense of manufacture and assembly and gives precise, uniform and reliable performance.

It is yet another object of this invention to provide a solenoid comprising components with sufficiently accurate and consistent tolerances to produce precise mechanical action.

It is still another object of the present invention to provide a solenoid with an armature that moves to precise, predetermined positions to perform various functions.

Other objects, advantages and features of the present invention will become apparent upon reading the following detailed description and appended claims, and upon reference to the accompanying drawings.

SUMMARY OF THE INVENTION

In accordance with one embodiment of this invention, a solenoid which achieves the foregoing objects includes a one-piece integrally molded bobbin unit with a bore and a retainer or catch that protrudes across and partially closes one end of the bore. The catch preferably is integral with a cantilever section of the side wall of the bore. It is resiliently retractable to permit ready insertion of an armature plunger into the bore, and yet to engage a stop shoulder on the plunger and define an end stop position for the armature thereafter. Thus, the catch and a plug stop at the other end of the bore confine a plunger in the bore between them within predetermined and well defined end limits. The bore and the plunger also have corresponding noncircular cross sections with the cross section of the plunger slightly reduced for a close fit in the bore, allowing for sliding movement of the plunger in the bore and preventing rotation of the plunger. One end of the plunger extends out from the bore beyond the catch to perform a mechanical function. A shaft mounted at the other end of the plunger extends beyond the respective end of the bobbin to perform another mechanical function. The bobbin supports a coil that produces the magnetic force to move the plunger longitudinally in the bore of the bobbin along a stroke limited by the catch and the stop.

In the operation of the solenoid, application of a voltage to the coil produces a flux within the core of the bobbin which moves the plunger in the direction of the plug stop. Removal of the voltage from the coil causes the flux to decrease, thereby reducing the magnetic force on the plunger and permitting another associated external or internal device to move the plunger longitudinally in the bore to the catch stop. Both the catch end stop and the opposite end stop define precisely determined positions.

BRIEF DESCRIPTION OF THE DRAWINGS

For a more complete understanding of this invention one should now refer to the embodiment illustrated in greater detail in the accompanying drawings and described below by way of an example of the invention. In the drawings:

FIG. 1 is a perspective view of a preferred embodiment of a solenoid embodying the present invention.

FIG. 2 is a sectional view taken along line 2—2 in FIG. 1.

FIG. 3 is a perspective view of the bobbin used in the solenoid of FIG. 1.

FIG. 4 is a sectional view taken along line 4—4 in FIG. 2.

FIG. 5 is a sectional view taken along line 5—5 in FIG. 2.

While the invention is described in connection with a preferred embodiment, it will be understood that the invention is not limited to this embodiment. Furthermore, it should be understood that the drawings are not to scale and that the embodiment is illustrated in part by graphic symbols, diagrammatic representations and fragmentary views. In certain instances, details may have been omitted which are not necessary for an understanding of the present invention.

DETAILED DESCRIPTION OF THE DRAWINGS AND A PREFERRED EMBODIMENT

Turning now to the drawings, FIG. 1 shows the preferred embodiment of an electromagnetic actuator or a solenoid generally at 10. The solenoid includes a base 11 which is a flat, elongate metal plate bent into a U-shape having a bottom portion 12 and two side flanges 13 and 14. The flanges 13 and 14 support a bobbin 15 which extends between them.

The bobbin 15 (shown separately in FIG. 3) is a one-piece, integrally molded unit made of a material such as glass-filled nylon. It comprises a tube or sleeve 16 with a cylindrical outer surface and a hexagonal inner bore or well 16*a* and two end flanges 17 and 18. The flange 18 is a flat rectangular plate molded to one end of the tube 16. It has an outwardly protruding wedge shaped lip 21 adapted to abut against the flange 14 of the base 11 for positioning the bobbin 15 relative to the base 11. The flange 17 is also a flat rectangular plate molded to the opposite end of the tube 16 a short distance from the respective end of the tube and adapted for abutting engagement with the flange 13 of the base 11. The short length of the tube 16 which extends beyond the flange 17 is a sleeve 22 molded into two separated portions, a bottom portion 23 and a cantilever-type retainer or catch 24 separated from the bottom portion by two slots or openings 24*a* and 24*b*. (See FIG. 5.) Thus, the catch 24 comprises a base section 25 which protrudes axially outward from the flange 17 and a section 26 which extends at a right angle to section 25, a short distance across and partially closing the bore 16*a* of the bobbin 15. (See FIG. 2.) Since the catch 24 is a cantilever-type member, separated from the bottom portion 23, it can flex outward and inward of the bore. The section 26 is axially beyond the end of the sleeve 16 to increase the length and flexibility of section 25.

To mount the bobbin 15 to the base 11, the bobbin 15 first is positioned with the sleeve 22 through an opening 27 in the side flange 13 so that the flange 17 of the bobbin 15 abuts against the flange 13 of the base 11. The opening 27 includes a round portion 28 sized to closely fit sleeve 22 and a rectangular relief portion 31 which allows for the unimpeded flexing of the catch 24. The other end of the bobbin 15 is secured to the flange 14 of the base 11 by a plug 32 made from material of high magnetic permeability. The plug 32 includes an enlarged portion 33 having a round, hexagonal or other cross section sized to fit snugly into the bore 16*a* of the bobbin 15. It also includes a reduced portion 34 having a round cross section sized to fit into a round opening 35 in the side flange 14 of the base 11. The outwardly protruding end of portion 34 may be staked as at 36 to hold the plug 32 in place against the side flange 14. A central aperture extends through the entire length of the plug 32. The aperture consists of a round bore 37 which extends through the center of the reduced portion 34 and part of the enlarged portion 33 and which develops into a conical recess 38 which extends, increasing in diameter, from the center of the enlarged portion 33 to the inward end of the plug 32.

The bobbin 15 supports a winding or coil 41 placed around the tube 16 between the flanges 17 and 18. The coil 41 may be covered by an additional insulative shell or wrapping 42, e.g., insulating tape.

The bobbin 15 also houses an armature plunger 43 within bore 16*a*. This plunger 43 is a metal rod or bar with a hexagonal cross section corresponding to the cross section of the bore 16*a* and sized for a close, sliding fit in bore 16*a*, whereby it has interfering or underlapping engagement with the catch 26, as shown in FIGS. 2 and 5. Catch section 26 may have a tapered outer surface to provide a camming action for ease of retracting the catch during insertion of the armature 43. The flexing catch 24 allows easy insertion of the plunger 43 in the bore 16*a*. One end portion of the plunger extends outside the bore 16*a* and has a transverse channel 44 formed therein. This end portion may be of any appropriate configuration adapted to receive, engage, or otherwise connect with a device which the plunger will move. This end also has a recess 45 into which the section 26 of the catch 24 returns after flexing to allow insertion of the plunger 43 into bore 16*a*. The recess 45 includes a shoulder 46 which the section 26 of the catch 24 engages as a stop to prevent the plunger 43 from moving farther out of the bore 16*a*.

The other end of the plunger 43 is tapered to conform generally to the contours of the conical recess 38 of the plug 32. This truncated end fits into the truncated conical recess 38 and engages the sides of the recess 38. Thus, the plug 32 stops the plunger 43 from moving farther out of the bore 16*a* in the opposite direction. A leader shaft 47, mounted to the truncated end by force fitting one end of the shaft 47 in an appropriately sized bore at the center of the plunger 43, protrudes through recess 38 and bore 37. When the plunger 43 moves into contact with plug 32, the shaft 47 extends beyond the side flange 14 of the base 11 and may perform a mechanical movement function upon another associated external device. The shaft may be of appropriate configuration adapted to perform the mechanical movement function.

The base 11 includes a mounting flange 48 (see FIGS. 4 and 5) provided with an opening 51 which receives a securing screw (not shown) or the like to hold the solenoid in place on a backplane.

The resiliently retractable catch 24 permits ready insertion of the plunger into the bobbin during initial assembly, and thereafter engages the stop shoulder 46 to provide a positive predetermined stop for the operation of the plunger. During the operation of the solenoid, application of a voltage to the terminals of coil 41 produces a flux within the bore 16*a* which moves the plunger 43 longitudinally within the bore 16*a* until the conical recess 38 of the plug 32 receives the truncated end of the plunger 43 and stops the plunger. The removal of the voltage from coil 41 causes the flux in the bore 16*a* to decrease, thereby reducing the magnetic force on the plunger 43 and permitting another associated external or internal device (not shown) to move the plunger 43 in the opposite direction until the catch section 26 contacts the shoulder 46 of the plunger 43 to stop the plunger. Thus, the plunger 43 moves along a path between two end stop points accurately defined by catch 24 and plug 32. The irregular cross section of the plunger 43 and the well 16*a*, which in the preferred embodiment is a hexagonal cross section, prevents rotation of the plunger 43 as it moves along this path.

Thus, a solenoid has been provided which meets the aforestated objects. The plunger will move to precise, predetermined positions upon application and removal of electric power and will perform various mechanical functions. The solenoid has a simplified construction which minimizes the expense of manufacture and assembly and gives precise, uniform and reliable performance.

While one preferred embodiment of the invention is illustrated, it will be understood, of course, that the invention is not limited to this embodiment. Those skilled in the art to which the invention pertains may make modifications and other embodiments employing the principles of this invention, particularly upon considering the foregoing teachings. Therefore, by the appended claims, it is intended to cover any such modifications and other embodiments as incorporate those features which constitute the essential features of this invention.

What is claimed is:

1. A solenoid device comprising an integrally molded bobbin provided with a central bore therein and including a resiliently retractable catch portion protruding into and partially closing said bore; a plunger extending into said bore and serving as an armature of such solenoid, said plunger adapted for axial, reciprocating movement in said bore and having a cross-section providing interfering engagement with said catch portion in said bore, with first stop means for stopping engagement with said catch; second stop means for limiting movement of said plunger in an opposite direction; and coil means surrounding said bobbin for generating magnetic flux to move said plunger; said plunger being formed of material having high magnetic permeability whereby said plunger may be inserted in said bore by resilient retraction of said catch portion and thereafter will engage said first and second stop means.

2. The solenoid device of claim 1, wherein said plunger and said bore interact to preclude relative rotary movement between said bobbin and said plunger.

3. The solenoid device of claim 2, wherein said plunger and said bore have noncircular complementary cross sections.

4. The solenoid device of claim 1, including a base member comprising a flat, elongate metal plate bent into a U-shape and having two spaced flanges that support said bobbin therebetween.

5. The solenoid device of claim 1, wherein said bobbin is a glass-filled nylon member.

6. The solenoid device of claim 1, wherein said stop means is a shoulder surface of said plunger.

7. The solenoid device of claim 1, wherein said catch is an L-shaped cantilever portion of said bobbin.

8. The solenoid device of claim 1, 2, 3, 4, 5, 6 or 7 wherein said catch is disposed at one end of said bore and extends partially across said one end.

9. The solenoid device of claim 1, 2, 3, 4, 5, 6 or 7 wherein said catch is disposed adjacent one end of said bore; a leader shaft is mounted at one end of said plunger; and said second stop means is a plug disposed in the end of said bore opposite said catch for stopping said plunger; said plug having receiving means for receiving said other end of said plunger and having an opening therethrough for receiving said leader shaft.

10. A solenoid device comprising a base member; an integrally molded bobbin mounted to said base member, said bobbin provided with a central bore therethrough and with a catch portion overhanging and partially closing one end of said bore; a plunger extending into said bore through said end and serving as an armature of such solenoid, said plunger adapted for non-rotating, axial, reciprocating movement in said bore and having a cross section providing interfering engagement with said catch portion in said bore with first stop means adjacent one end for stopping engagement with said catch and a leader shaft mounted at the other end; a plug disposed in the other end of said bore for stopping said plunger, said plug having receiving means for receiving said other end of said plunger and having an opening therethrough for receiving said leader shaft; coil means surrounding said bobbin for generating magnetic flux to move said plunger between said catch and said plug; a shell surrounding said coil means for protecting said coil means; said plug and said plunger formed of material having high magnetic permeability and said plunger may be inserted in said bore by resilient retraction of said catch portion and thereafter will engage said first stop means and said plug.

11. The solenoid of claim 10, wherein said plunger and said bore have noncircular cross sections.

12. The solenoid of claim 10, wherein said plunger and said bore have hexagonal cross sections.

13. The solenoid of claim 10, wherein said bobbin is a glass-filled nylon member.

14. The solenoid of claim 10, wherein said stop means is a shoulder surface of said plunger.

15. The solenoid of claim 10, wherein said receiving means is a conical recess.

16. The solenoid of claim 10, wherein said opening is a round bore and said leader shaft is a round bar having a diameter smaller than the diameter of said opening.

17. The solenoid of claim 10, wherein said base member is a flat, elongate plate bent into a U-shape and having two flanges that support said bobbin.

18. The solenoid of claim 10, 11, 12, 13 wherein said catch is a resilient L-shaped cantilever portion of said bobbin.

* * * * *